United States Patent [19]

Kawatei

[11] Patent Number: 4,489,697

[45] Date of Patent: Dec. 25, 1984

[54] DISTRIBUTOR TYPE FUEL INJECTION PUMP HAVING A STARTING INJECTION TIMING ADVANCE DEVICE

[75] Inventor: Hisatsugu Kawatei, Higashi-Matsuyama, Japan

[73] Assignee: Diesel Kiki Co., Ltd., Tokyo, Japan

[21] Appl. No.: 468,652

[22] Filed: Feb. 22, 1983

[51] Int. Cl.[3] ..... F02M 59/20

[52] U.S. Cl. ..... 123/502; 123/506; 123/459; 137/469

[58] Field of Search ..... 123/502, 506, 514, 510, 123/511, 512, 513, 459, 458, 449, 179 G; 417/462; 137/469, 475

[56] References Cited

U.S. PATENT DOCUMENTS

| | | | |
|---|---|---|---|
| 2,295,931 | 9/1942 | Caminez | 137/469 |
| 4,030,522 | 6/1977 | Heiser | 137/469 |
| 4,387,683 | 6/1983 | Eheim | 123/502 |

FOREIGN PATENT DOCUMENTS

| | | | |
|---|---|---|---|
| 92329 | 7/1981 | Japan | 123/502 |
| 13236 | 1/1982 | Japan | 123/502 |

*Primary Examiner*—Magdalen Y. C. Moy

*Attorney, Agent, or Firm*—Frishauf, Holtz, Goodman and Woodward

[57] ABSTRACT

In a distributor type fuel injection pump for use with an internal combustion engine, which is equipped with an injection timing control device operable in response to oil pressure within a pressure oil chamber, which is variable as a function of the rotational speed of the engine, an overflow valve is provided, which is closed at the start of the engine when the oil pressure within the pressure oil chamber is low, and is opened during subsequent operation of the engine to cause escape of the above oil pressure to a lower pressure zone in the pump, to thereby cause the above injection timing control device to obtain an advance in the fuel injection timing.

6 Claims, 8 Drawing Figures

DISTRIBUTOR TYPE FUEL INJECTION PUMP HAVING A STARTING INJECTION TIMING ADVANCE DEVICE

BACKGROUND OF THE INVENTION

This invention relates to a fuel injection pump for internal combustion engines, and more particularly to a starting injection timing advance device provided in such pump.

Internal combustion engines, particularly in double cell type Diesel engines, are difficult to start in cold weather. Conventionally, to facilitate starting of an engine of this type in cold weather, a glow plug is used to heat the suction air being supplied to the engine, and in some engines, a starting injection timing advance device is used to advance the fuel injection timing at the start of the engine, which device also serves to prevent occurrence of HC in the exhaust gases of the engine.

One of such starting injection timing advance devices has been proposed by Japanese Utility Model Provisional Publication No. 55-49078, which comprises an auxiliary piston arranged for urging contact with one end of a timer piston which forms part of an injection timing control device and is displaceable in response to fuel pressure variable as a function of the rotational speed of the engine, and having a larger pressure applying surface area than the timer piston, and a spring urging the auxiliary piston toward the timer piston. At the start of the engine, low fuel pressure acts upon the auxiliary piston so that the auxiliary piston is urged by the force of the spring to bias the timer piston in the injection timing advancing direction. As the engine speed subsequently increases, correspondingly increased fuel pressure causes the auxiliary piston to be displaced away from the timer piston against the force of the spring to then allow the latter to carry out a usual injection timing controlling action.

However, the proposed starting injection timing advance device is large in size because of its auxiliary piston having a large pressure applying surface area, and is therefore is difficult to install into a narrow mounting space in a vehicle or the like. Further, it is rather complicate in construction and not easy to assemble.

SUMMARY OF THE INVENTION

It is an object of the invention to provide a distributor type fuel injection pump provided with a novel starting injection timing advance device which is simple in construction and easy to assemble, and does not require a large mounting space.

The distributor type fuel injection pump according to the present invention comprises: a housing defining therein a pressure oil chamber having internal oil pressure variable as a function of the rotational speed of the engine; fuel injection timing control means operable in response to the oil pressure in the pressure oil chamber; and an overflow valve which is comprised of a cylinder having its interior communicating at one side with the above pressure oil chamber, and at another side with a lower pressure zone in the pump, a piston slidably received within the cylinder, of which one end corresponding to the above one side of the cylinder is formed with a pressure applying portion with a variable pressure applying surface area, upon which the oil pressure in the pressure oil chamber permanently acts, orifice means for permitting escape of the oil pressure in the pressure oil chamber through said piston to the interior of the cylinder communicating with the lower pressure zone, and urging means permanently urging the other end of the piston toward an extreme position thereof.

In the above extreme position, the piston is adapted to interrupt the communication between the interior of the cylinder and the pressure oil chamber and its pressure applying portion has a minimum pressure applying surface area. The above urging means has such a predetermined setting load as it keeps the piston in the above extreme position against the force of the pressure in the pressure oil chamber at the start of the engine. Thus, at the start of the engine, overflow of the pressure oil from th pressure oil chamber to the lower pressure zone through the low valve is prevented, to elevate the oil pressure in the pressure oil chamber.

The above and other objects, features and advantages of the invention will be more apparent from the ensuing detailed description taken in connection with the accompanying drawings.

DETAILED DESCRIPTION

Figure 1:
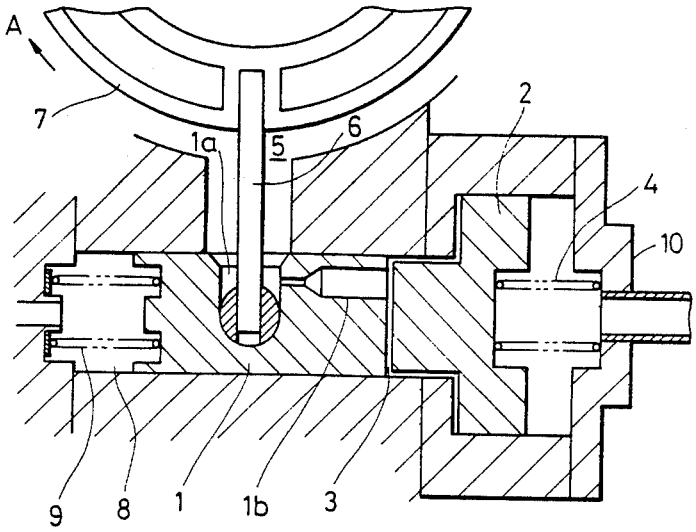
FIG. 1 PRIOR ART
FIG. 1 is a fragmentary sectional view of a starting injection timing advance device provided in a conventional distributor type fuel injection pump.
Figure 2:
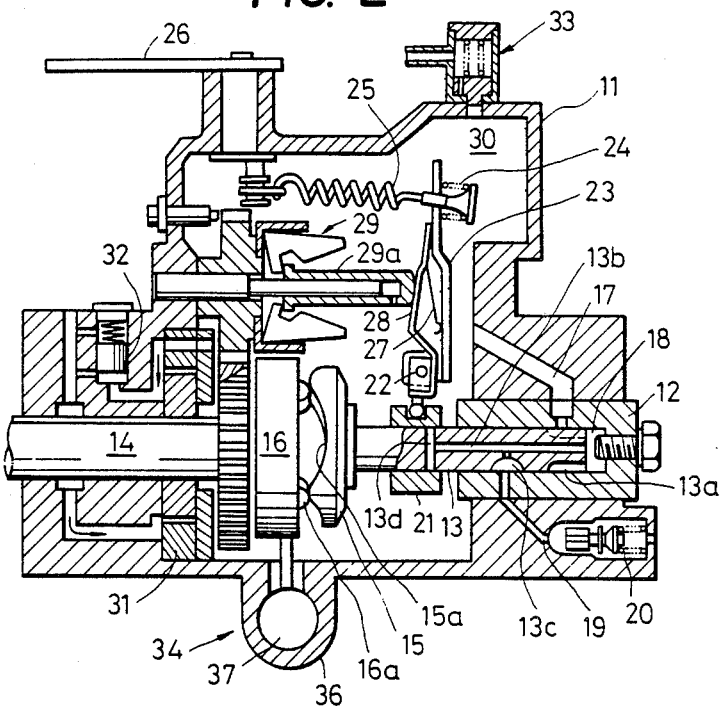
FIG. 2 is a longitudinal sectional view of a distributor type fuel injection pump according to an embodiment of the present invention.

Referring to FIG. 1, there is illustrated an injection timing control device for use with a distributor type fuel injection pump, which has been proposed by Japanese Utility Model Provisional Publication No. 55-49078 previously referred to. An auxiliary piston 2 is arranged in concentricity with a timer piston 1. This auxiliary piston 2 has a larger pressure applying surface area than the timer piston 1, and has one end facing a pressure working chamber 3 defined at one end of the timer piston 1 and disposed for urging contact with the timer piston 1, while having the other end urged by a spring 4. The pressure working chamber 3 communicates, through passages 1*a* and 1*b* formed in the timer piston 1, with a suction chamber or pressure oil chamber 5 of the fuel injection pump, which is filled with pressurized fuel having its pressure variable in proportion to the rotational speed of an engine associated with the pump. Thus, when the oil pressure in the suction chamber 5 is low at the start of the engine, the auxiliary piston 2 is urged by the spring 4 to bias the timer piston 1 in the leftward direction as viewed in FIG. 1 so that a roller holder 7, which engages with the timer piston 1 via a connecting lever 6, is biased in a clockwise direction indicated by the arrow A to obtain an advanced in the fuel injection timing. As the rotational speed of the engine then increases to correspondingly elevate the oil pressure in the suction chamber 5, the elevated oil pressure flows into the pressure working chamber 3 through the passages 1*a* and 1*b* to move the auxiliary piston 2 in the rightward direction against the force of the spring 4. At the same time, the timer piston 1 is urgedly moved in the rightward direction by a timer spring 9 accommodated within an opposite chamber 8 to retard the fuel injection timing. With a further increase in the engine speed and accordingly a further corresponding increase in the pressure in the suction chamber 5, the auxiliary piston 2 is further moved against the force of the spring 9 into urging contact with a cover 10, and thereafter, the timer piston 1 is moved in the leftward direction against the force of the timer spring 9, by the increased oil pressure in the pressure working chamber 3, thus carrying out control of the fuel injection timing in response to the engine speed. The injection timing control at low pressure in the suction chamber 5 is effected in the above manner.

The proposed starting timing advance device is, however, inevitably large in size due to its construction that the auxiliary piston 2 having a larger pressure applying surface area than the timer piston 1 directly drives the timer piston, requiring a large mounting space. Further, equipped with such auxiliary piston, etc. the injection timing control device is inevitably complicated in construction.

Another alternative method for obtaining an advance in the injection timing may be considered, which comprises setting at a higher value than a usual value the valve opening pressure of a regulating valve or pressure control valve, not shown, which controls the fuel pressure within the suction chamber 5 in dependence upon the engine speed, so that higher pressure within the suction chamber 5 is obtained at the start of the engine. However, according to this method, even during subsequent engine operation after the start of the engine, the injection timing control device is kept in a timing advancing position, making it impossible to achieve an optimum timing characteristic responsive to the engine speed.

FIGS. 2 through 5 illustrate a distributor type fuel injection pump according to an embodiment of the present invention. A pump plunger 13 is slidably fitted in a plunger barrel 12 mounted within a pump housing 11. A cam disc 15 is mounted on an end of the plunger 5 and coupled with a pump drive shaft 14 for rotation therewith. A roller holder 16 carrying a plurality of rollers 16*a* is disposed concentrically with the drive shaft 14 in a fashion that the cam disc 15 has its camming surface 15*a* urged against the rollers 16*a* by means of a coil spring, not shown, or like means. Thus, the cam disc 15 and accordingly the plunger 13 are adapted to make rotational and reciprocating motions at the same time in unison with the rotation of the drive shaft 14.

The motions of the plunger 13 cause the fuel delivered there through a fuel feeding line 17 to travel through end notches 13*a*, a pump working chamber 18, a central axial bore 13*b*, and a side opening 13*c*, all formed in or by the plunger 13, and passages 19 and delivery valves 20, only one of which is shon, in the mentioned order, to be fed to injection valves, not shown, provided in engine cylinders, not shown. A fuel quantity setting sleeve 21 is slidably fitted on the plunger 13, which cooperates with a radial port 13*d* formed in the plunger 3 in communication with the central axial bore 13*b* to determine the axial stroke of the plunger 13 and accordingly the fuel injection quantity. The sleeve 21 is in engagement with a control lever 26 arranged on the housing 11 by way of a fixed common fulcrum 22, a tension lever 23, an idling spring 24 and a control spring 25. The fixed common fulcrum 22 is also engaged by a starting spring 27 and a starting lever 28 which are urged by the movable sleeves 29*a* of a centrifugal governor 29 to bias the sleeve 21 in a fuel quantity increasing direction.

The interior of the housing 11 is formed as a pressure oil chamber or suction chamber 30 filled with pressurized fuel. Fuel in a fuel tank, not shown, is pumped by a fuel pump, not shown, and then pressurized by a feed pump 31 which is driven by the pump drive shaft 14 at speeds proportional to the engine speed and the pressurized fuel has its pressure adjusted to a value proportional to the engine speed by a regulating valve 32, before being delivered into the suction chamber 30. Part of the fuel in the suction chamber 30 is spilled through an overflow valve 33 peculiar to the present invention, mounted on the housing 11 and is returned to the fuel tank. Details of the overflow valve 33 will be described later.

Figure 3:
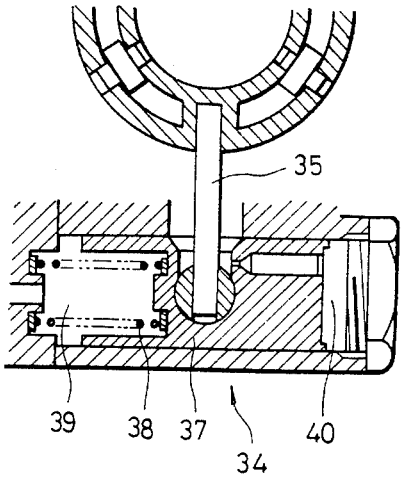
FIG. 3 is a fragmentary sectional view of an injection timing control device provided in the fuel injection pump of FIG. 2.
Figure 4:
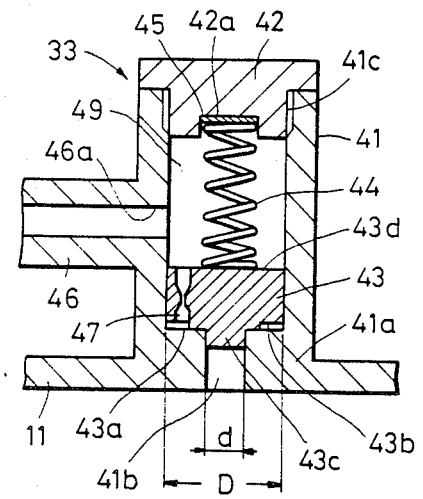
FIG. 4 is a fragmentary sectional view, on an enlarged scale, of an overflow valve shown in FIG. 2.

Provided at the lower part of the housing 11 is an injection timing control device 34 upon which acts the fuel pressure in the suction chamber 30 adjusted as above, and which has a conventional construction. To be concrete, the roller holder 16, which is pivotably arranged in concentricity with the drive shaft 14, is engaged by an acting point on an end of a connecting lever 35 which has another acting point on its other end in engagement with a timer piston 37 fitted within a cylinder 36 projecting from the lower surface of the housing 11, as shown in FIG. 3. Defined by the inner walls of the cylinder 36 and the opposite end faces of the piston 37 are a chamber 39 in which a coil spring 38 is accommodated and a pressure working chamber 40 in which fuel delivered from the suction chamber 30 acts upon the piston 37. The position of the piston 37 and accordingly the circumferential position of the roller holder 16 connected thereto by the connecting lever 35 are determined by the difference between the force of the spring 38 and the pressure in the chamber 40. A change in the circumferential position of the roller holder 16 causes a change in the position of contact between the rollers 16*a* and the camming surface 15*a* of the cam disc 15, which in turn causes a change in the relationship between the circumferencial phase of the drive shaft 14 and the above position of contact, i.e. the acting position of the plunger 13, so that there occurs a change in the injection timing with respect to the angle of rotation of the drive shaft 14.

The overflow valve 33 is fixed on the upper surface of the housing 11 and comprises a cylinder 41 secured at one end on the housing 11, a cap 42 fitted in the other end of the cylinder 41 and hermetically enclosing same, a piston 43 slidably received within the cylinder 41, a coil spring 44 disposed for biasing the piston 43, and a shim 45 interposed between the coil spring 44 and the cap 42. The above one end of the cylinder 41, which also forms part of the wall of the housing 11, has its end wall formed at its diametric center with a through bore 41*b* having a predetermined inner diameter smaller than the inner bore D of the cylinder 41. The through bore 41*b* opens in the suction chamber 30 to communicate the interior of the cylinder 41 with the same chamber 30. A conduit 46 is integrally formed on the cylinder 41 in a manner extending from the peripheral wall of the cylinder at a location between the other end of the cylinder 41 and the piston 43, which has an internal passage 46*a* opening in the interior of the cylinder 41 and leading to a lower pressure zone in the pump, such as a fuel tank, not shown. The cap 42 is threadedly fitted in the open end 41*c* in a manner hermetically enclosing same. It has a recess 42*a* formed in its inner end face at a central location, in which one end of the coil spring 44 is supportedly fitted.

Figure 6:
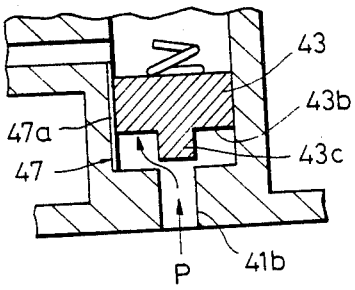
FIG. 6 is a fragmentary sectional view of a variant of the overlow valve of FIG. 2.
Figure 8:
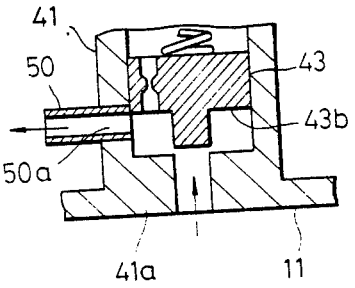
FIG. 8 is a fragmentary sectional view of a further variant of the overflow valve according to the invention.

The piston 43 in the cylinder 41 has an end face facing toward the through bore 41*b* of the cylinder 41 and formed as a pressure applying surface 43*a* with a variable pressure applying surface area. This pressure applying portion 43*a* is formed by a radially outer annular portion 43*b* of the end face of the piston 43 and a cylindrical protuberance 43*c* integrally axially projected from a central portion of the same end face and having such a diameter as it can be snugly fitted into the through bore 41*b* in the cylinder 41. Thus, the pressure applying surface area of the pressure applying portion 43*a* varies as the piston 43 moves within the cylinder 41 to have the protuberance 43*c* engaged into or disengaged from the through bore 41*b*. That is, the effective pressure applying surface area is $\pi d^2/4$ from the through bore 41*b* when the protuberance 43*c* is engaged in the through bore 41*b*, and $\pi D^2/4$ when the former is disengaged from the latter, respectively. An axial orifice bore 47 is formed through the piston 43 at a radially outer portion, which communicates the fuel space facing the end face 43*b*, 43*c* of the piston 43 with the interior of the cylinder 41 facing the opposite end face 43*d* of same. Alternatively of the orifice bore 47, an orifice may be formed by a longitudinal groove 47*a* formed in the inner peripheral wall of the cylinder 41 and the outer peripheral surface of the piston 43 disposed in slidable contact therewith, as shown in FIG. 6.

A shim 45 with a preselected thickness is fitted in the recess 42*a* formed in the cap 42, with the coil spring 44 interposed between the shim 45 and the end face 43*d* of the piston 43. The coil spring 44 urges the piston 43 toward the open end or through bore 41*b* of the cylinder 41, setting the actuating pressure of the piston 43. The thickness of the shim 45 is previously set to a suitable value to adjust the setting load of the spring 44 so as to obtain a suitable actuating pressure of the piston 43.

The pressure applying surface areas of the pressure applying portions 43*b*, 43*c*, the bore of the orifice, the setting load of the coil spring 44, etc. are suitably set so as to achieve a desired oil pressure characteristic in the suction chamber, to obtain appropriate injection timing dependent upon the engine speed.

With the above arrangement, when the engine is at rest, the pressure P in the suction chamber 30 is zero, and accordingly, the piston 43 of the overflow valve 33 is urgedly biased by the coil spring 44, with its central protuberance 43*c* fitted into the open end or through bore 41*b* of the cylinder 41 to close same. In the fuel injection pump provided with the overflow valve 33 according to the invention, the regulating valve, not shown, has its valve opening pressure set at a value slightly higher than that in a conventional fuel injection pump of this type, that is, at such a value that a proper injection timing advance is obtained at the start of the engine.

Figure 5:
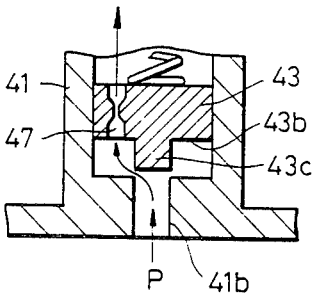
FIG. 5 is a fragmentary sectional view of the overflow valve of FIG. 4, with its valve body in a lifted position.

At the start of the engine when the engine rotational speed is within a range of 0–100 rpm for instance, the piston 43 of the overflow valve 33 is positioned to close the open end 41*b* of the cylinder 41, as noted above, that is, the overflow quantity is zero. Accordingly, the suction chamber pressure P rapidly increases as the engine speed rises from zero, as indicated by the portion Ia of the curve I in FIG. 7. Responsive to this sudden rise of the suction chamber pressure P, the timer piston 37 in FIG. 3 is displaced in the injection timing advancing direction. On this occasion, the piston 43 of the overflow valve 33 has its central pressure applying portion 43*c* alone acted upon by the suction chamber pressure P, and it does not lift until after the suction chamber pressure P has increased beyond a pressure Pa set by the coil spring 44. When the engine speed then increases and accordingly the suction chamber pressure P increases beyond the above preset pressure Pa, the piston 43 is lifted by the pressure P against the force of the coil spring 44 to bring its pressure applying protuberance 43*c* out of the open end 41*b*, as illustrated in FIG. 5. Then, part of the fuel in the suction chamber 30 flows through the open end 41*b* into the cylinder 41, and then through the orifice 47 in the piston 43 into the cylinder chamber 49, and then returned to the fuel tank, not shown, by way of the passage 46*a* of the conduit 46. This overflow of fuel causes a drop in the suction chamber pressure P. On this occasion, the piston 43 has its both pressure applying surfaces 43*b* and 43*c* acted upon by the pressure P with an increased pressure applying surface area, it has a very small drop in its lift even with a drop in the suction chamber pressure P as indicated by the portion Ib of the curve I in FIG. 7, and consequently the central pressure applying protuberance 43*c* of the piston 43 will not close the open end 41*b* of the cylinder 41 to prevent the overflow amount from becoming zero again. After this, the suction chamber pressure P increases with a further increase in the engine speed N, as indicated by the linear portion Ic of the curve I in FIG. 7.

Figure 7:
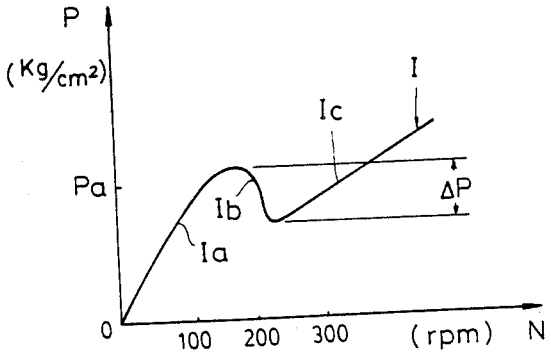
FIG. 7 is a graph showing an example of a curve indicative of pressure in the pressure oil chamber of the distributor type fuel injection pump according to the invention.

As noted above, according to the invention, since the overflow of the suction chamber fuel is kept zero only at the start of the engine, whereas during other operations of the engine the overflow is continuously carried out in the above manner, the suction chamber pressure P can be elevated to a desired value at the start of the engine so as to obtain a required injection advance, and after the start of the engine the suction chamber pressure P can be regulated in dependence upon the engine speed, as generally represented by the curve I in FIG. 7, permitting to achieve an optimum injection timing characteristic. Incidentally, the slope of the portion Ic of the curve I in FIG. 7 depends upon the diameter of the orifice 47 in the piston 43 of the overflow valve 33.

In the curve I of FIG. 7, the pressure drop amount $\Delta P$ of the suction chamber pressure P is a function of the fuel overflow amount, that is, it becomes larger as the overflow increases. Therefore, if a desired pressure drop $\Delta P$ cannot be obtained with the arrangement of FIG. 4, a conduit 50 may be connected to the cylinder 41 in a manner that its one end opens in the interior of the cylinder 41 at a location between the end wall 41*a* and the end face 43*b* of the piston 43, to allow part of the overflow fuel to escape through the internal passage 50*a* in the conduit 50 to the inlet side of an associated feed pump, not shown, to thereby achieve a desired pressure drop ΔP.

While preferred embodiments of the invention have been described, variations thereto will occur to those skilled in the art within the scope of the present inventive concepts which are delineated by the following claims.

What is claimed is:

1. In a distributor type fuel injection pump for an internal combustion engine having a housing defining therein a pressure oil chamber having an internal oil pressure variable as a function of the rotational speed of said engine, fuel injection timing control means operable in response to the oil pressure in said pressure oil chamber, and an overflow valve including a cylinder having an interior thereof communicating at one side thereof with said pressure oil chamber, and at another side with a lower pressure zone in said pump, a piston slidably received within the cylinder, and urging means urging said piston, the improvement comprising:

said cylinder of said overflow valve having an end wall forming part of said housing and having a central through hole opening in said pressure oil chamber;

said overflow valve including orifice means for permitting escape of the oil pressure in said pressure oil chamber through said piston to said lower pressure zone;

said piston having one end corresponding to said one side of said cylinder and formed with a pressure applying portion having a variable pressure applying area, upon which the oil pressure in said pressure oil chamber permanently acts, said pressure applying portion of said piston comprising an end face of said one end and a protuberance formed integrally on said end face of said one end, said protuberance of said piston being adapted to be fitted into and out of said through hole formed in said cylinder, in unision with movement of said piston responsive to changes in the oil pressure in said pressure oil chamber;

said piston having an extreme position at which said protuberance of said piston is fitted into said central through hole in said cylinder to interrupt communication between the interior of said cylinder and said pressure oil chamber, said pressure applying portion being formed by said protuberance alone and thus having a minimum pressure applying surface area when said piston is in said extreme position;

said urging means permanently urging said piston toward said extreme position thereof, said urging means having such a predetermined setting load as to keep said piston in said extreme position against the force of the oil pressure in said pressure oil chamber at the start of said engine;

said piston being adapted to be displaced away from said extreme position against said load of said urging means, as the rotational speed of said engine increases immediately after the start of the engine, so that said protuberance of said piston moves out of said central through hole formed in said cylinder to establish communication between the interior of said cylinder and said pressure oil chamber through said orifice means whereby said pressure applying portion of said piston is formed by both of said end face and said protuberance and thus has an increased pressure applying area;

whereby at the start of said engine, overflow of the pressure oil from said pressure oil chamber to said lower pressure zone through said overflow valve is prevented, to elevate the oil pressure in said pressure oil chamber and thereby obtain a required injection advance at the start of the engine by said fuel injection timing control means, whereas, during normal operation after the start of the engine, said overflow of the pressure oil is permitted, to permit obtaining ordinary injection advance during normal operation of the engine.

2. A distributor type fuel injection pump as claimed in claim 1 wherein said orifice means comprises an orifice bore formed through said piston.

3. A distributor type fuel injection pump as claimed in claim 1, wherein said cylinder has an inner wall surface and said piston has an outer peripheral surface disposed in slidable contact with said inner wall surface of said cylinder, said orifice means comprising a longitudinal groove formed in said inner wall surface of said cylinder and said outer peripheral surface of said piston.

4. A distributor type fuel injection pump as claimed in claim 1, wherein said cylinder has am end wall, said urging means comprises a coil spring having one end disposed in urging contact with said end wall of said cylinder and another end disposed in urging contact with another end of said piston, and a shim interposed between said one end of said coil spring and said end wall of said cylinder, said shim having such a thickness as to impart said predetermined setting load to said coil spring.

5. A distributor type fuel injection pump as claimed in claim 1, further comprising a conduit having one end connected to said cylinder in a manner such that it opens in said cylinder at a location between said one end wall of said cylinder and said one end of said piston, and leading to said lower pressure zone.

6. A distributor type fuel injection pump as claimed in claim 1, wherein said oil pressure in said pressure oil chamber is fuel pressure filled in said pressure oil chamber.

* * * * *